US007098763B2

(12) United States Patent
Larcher

(10) Patent No.: US 7,098,763 B2
(45) Date of Patent: Aug. 29, 2006

(54) SWITCHING HOUSING FOR AN ELECTRICAL SWITCHING DEVICE

(75) Inventor: Patrick Larcher, Ahuy (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 176 days.

(21) Appl. No.: 10/757,494

(22) Filed: Jan. 15, 2004

(65) Prior Publication Data

US 2004/0140188 A1 Jul. 22, 2004

(30) Foreign Application Priority Data

Jan. 20, 2003 (FR) ..... 03 00626

(51) Int. Cl.
*H01H 67/02* (2006.01)

(52) U.S. Cl. ..... 335/132; 335/202

(58) Field of Classification Search ..... 335/8–10, 335/132, 201–202; 218/149, 156
See application file for complete search history.

(56) References Cited

U.S. PATENT DOCUMENTS 4,470,028 A * 9/1984 Vayre et al. ..... 335/16
5,218,332 A * 6/1993 Blanchard et al. ..... 335/132

FOREIGN PATENT DOCUMENTS

FR 196 30 471 A1 1/1998

* cited by examiner

*Primary Examiner*—Lincoln Donovan
(74) *Attorney, Agent, or Firm*—Steptoe & Johnson LLP

(57) ABSTRACT

Electrical switching device with a switching housing designed to be fitted with at least one switching polar assembly (80) comprising two arc extinguishing splitters blocks (81,82) located on each part of a contact bridge (83) movable along a horizontal axis. The switching housing comprises a first element (20) comprising a bottom (21) formed from a first horizontal face of the switching device (10), so as to form a tank with a cavity (29) that houses a first splitters block (81), and a second element (30), assembled to the first element (20), comprising a bottom (31) formed from a second horizontal face of the switching device (10), opposite the first horizontal face, so as to form a tank with a cavity (39) that collects the second splitters block (82). The invention also relates to a method of assembling such a switching device.

9 Claims, 3 Drawing Sheets

Figure 1:
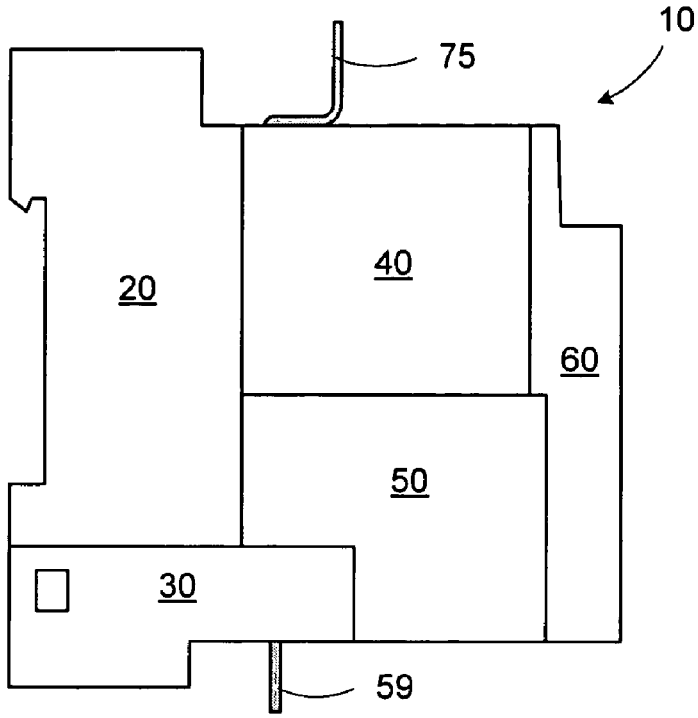

FIG. 2
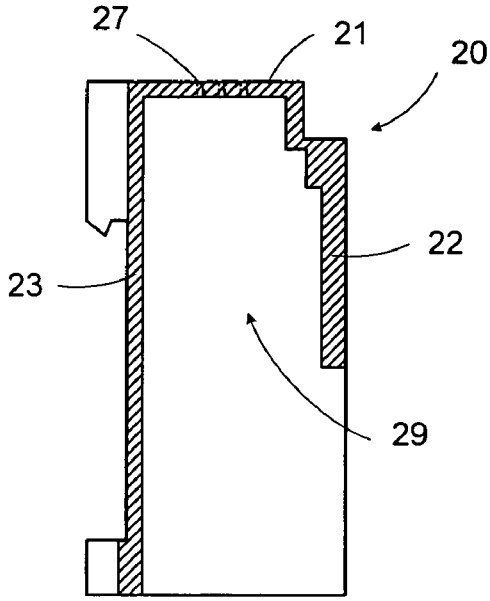
FIG. 3
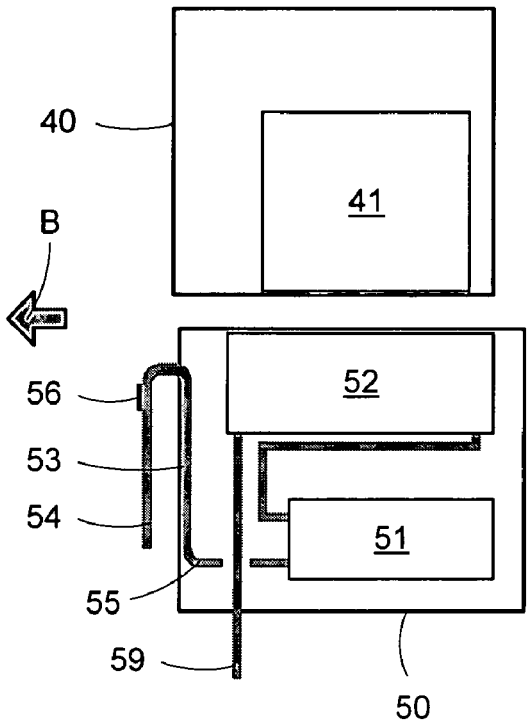
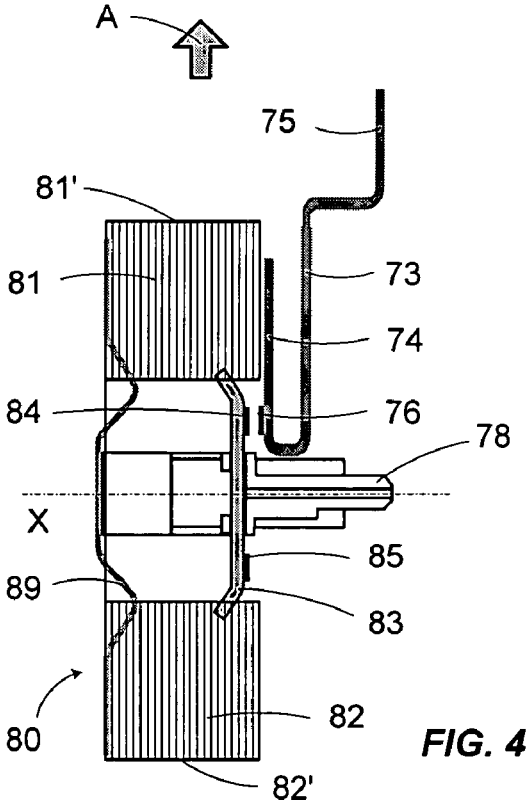
FIG. 4

SWITCHING HOUSING FOR AN ELECTRICAL SWITCHING DEVICE

This invention relates to a low voltage electrical switching device, particularly of the contactor, circuit breaker or contactor-circuit breaker type, comprising a switching housing composed of two parts, each part forming a housing surrounding arc extinguishing splitters blocks for better stiffness and better resistance to gas pressure. The invention also relates to a method for assembling such a switching device.

Electrical switching devices exist that comprise arc-control devices in which arc extinguishing splitters dissipate and evacuate the electric arc that arises when two contacts are opened, as quickly as possible. These arc-control devices must be capable of resisting large electric arcs and high gas overpressures on the downstream of electric arcs, particularly in a device designed for protection against short circuit currents. Arc-control devices are incorporated in a switch housing, and therefore the walls of this housing have to be capable of resisting these overpressures generated during opening of the pole contacts.

Normally, the switching device comprises a housing made of an insulating material with a tank-shaped base, the bottom of which forms a back face of the switching device. The tank is open at the front such that the constituents of the polar switching assemblies (for example the mobile contact bridge, bridge actuation pusher, contact pressure spring, bridge holding casing, arc extinguishing splitters blocks, deflectors, etc . . . ) can be inserted into the tank from the front.

Ordinarily, polar switching assemblies are completely or partially assembled before they are inserted in the tank, in order to facilitate assembly of the switching device. The tank is then covered by a cover or a cap making it leak tight and thus forming a switching housing divided into several arc-control devices for different power poles of the switching device. The cover also supports the trip system that could activate the mobile contacts of the switching device. For example, this trip device may be a mechanical locking block, a magnetic switching block and/or a thermal switching block.

The junction between the tank and the cover must be designed carefully because it is subjected to high stresses related to overpressure of gases particularly near the external end of the splitters blocks, corresponding to the area in which the gas overpressure is high. In one normal configuration, the opening of the switching housing tank, and therefore the junction area between the tank and the cover, extends over almost the entire front face of the tank, otherwise it would be difficult to insert the various constituents of the polar switching assemblies into the switching housing, particularly when they are assembled in advance. Consequently, the area occupied by this junction area is large and includes the area near the end of the splitters block. This generates large forces due to pressure that cause mechanical weakness of the switching housing which has to be compensated particularly by strong attachment devices to maintain good seal between the tank and the cover.

Therefore it would be advantageous to design a simple switching housing arrangement in order to reduce overpressure stresses inside the arc-control devices, but capable of maintaining fast and easy assembly of the polar switching assembly(ies) and the trip system, particularly in high rating switches that have to resist high electrical currents.

Therefore, one of the purposes of this invention is to provide better mechanical resistance and better seal to gas overpressures in this junction area in the switching housing by reducing the area occupied by the junction area and increasing the stiffness of the different parts forming the switching housing.

To achieve this, the invention describes an electrical switching device comprising a switching housing designed to hold at least one polar switching assembly provided with two arc extinguishing splitters blocks located on each side of a mobile contact bridge that can move along a horizontal displacement axis. The switching housing comprises a first element comprising two sidewalls, one back wall, one front wall and a bottom formed by a first horizontal face of the switching device so as to form a tank with a cavity that collects a first splitters block of the polar switching assembly, and a second element distinct from the first element and comprising two side walls, one back wall, one front wall and a bottom consisting of a second horizontal face of the switching device opposite the first horizontal face, so as to form a tank with a cavity that collects the second splitters block of the polar switching assembly.

According to one characteristic, each element of the switching housing of a multipole switching device also comprises a separation partition between each adjacent pole fixed to the back and front walls and to the bottom of the said element. According to another characteristic, each element of the switching housing is preferably composed of a single moulded part.

Thus, the junction area between the first and second elements of the switching housing is located in a plane that is approximately parallel to the first and second horizontal faces of the switching housing, while in known solutions this junction area is located in an approximately vertical plane perpendicular to the horizontal displacement axis of the contact bridge. Since the height of the switching housing in such a switching device is greater than its depth due to the arrangement of the switching assemblies, it follows that the junction area advantageously occupies a significantly smaller area with better mechanical strength.

Another purpose of the invention is to propose a simple and fast method of assembling such an electrical switching device.

To achieve this, the assembly method comprises a number of steps in sequence, a step to insert polar switching assemblies inside the first element of the switching housing, a step to hang a trip system against the first element, then a step to fix the second element of the switching housing to the first element so as to simultaneously close the switching housing and enable locking of the trip system.

According to one characteristic, the trip system hanging step includes a step for latching a mechanical locking block to the first element and then a step for latching a magneto/thermal block to the mechanical locking block.

Figure 6:
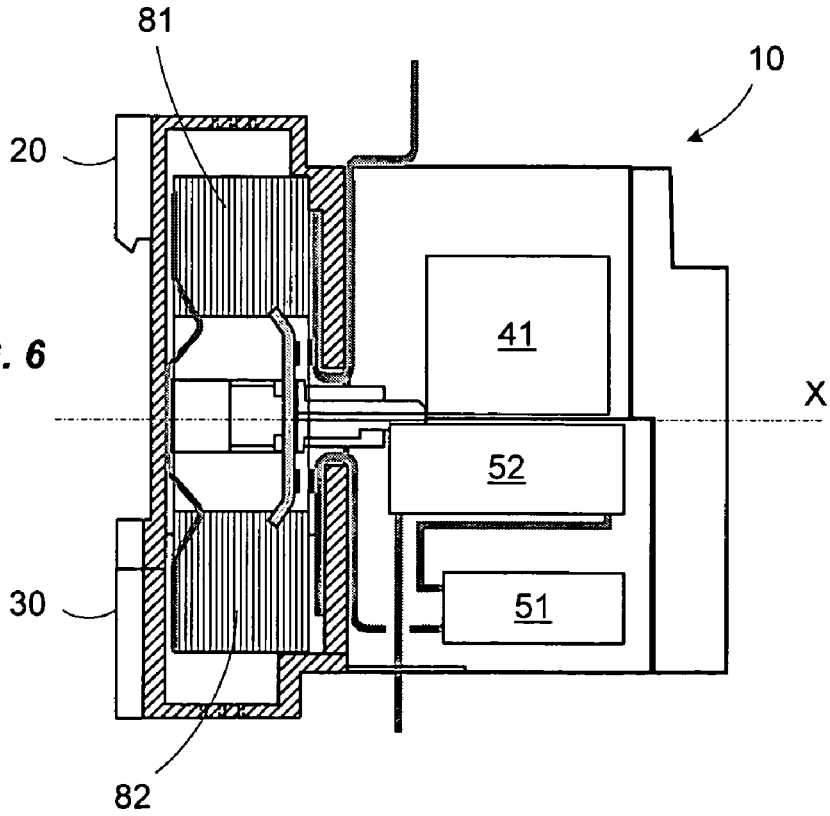
Figure 5:
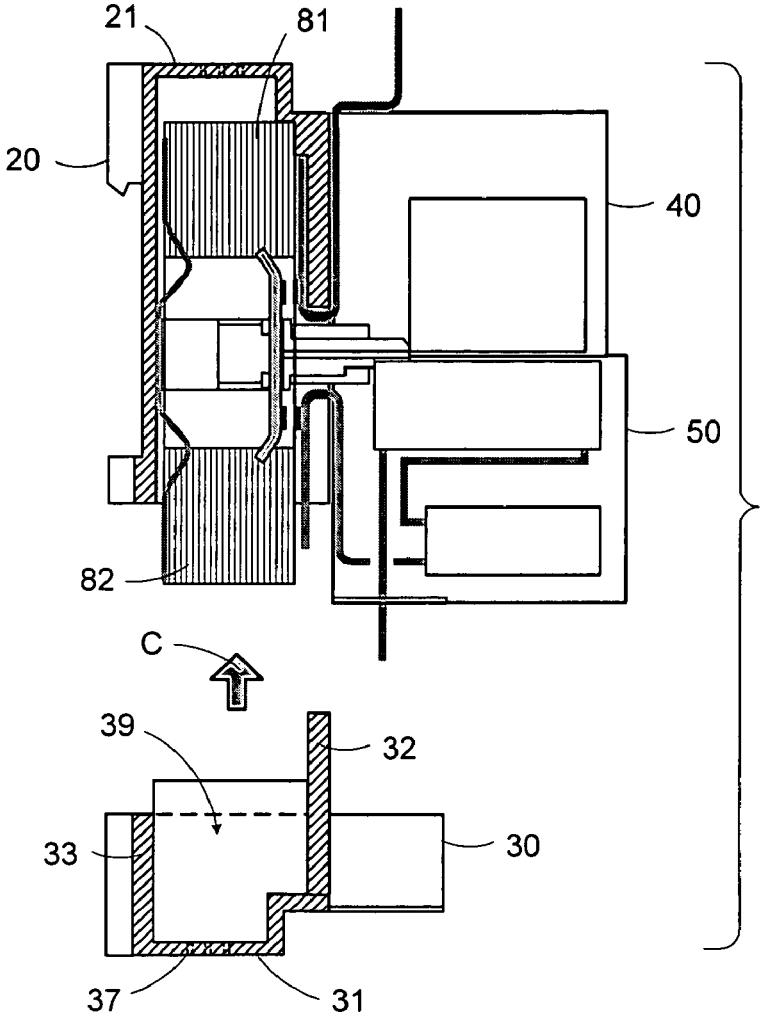
Figure 7:
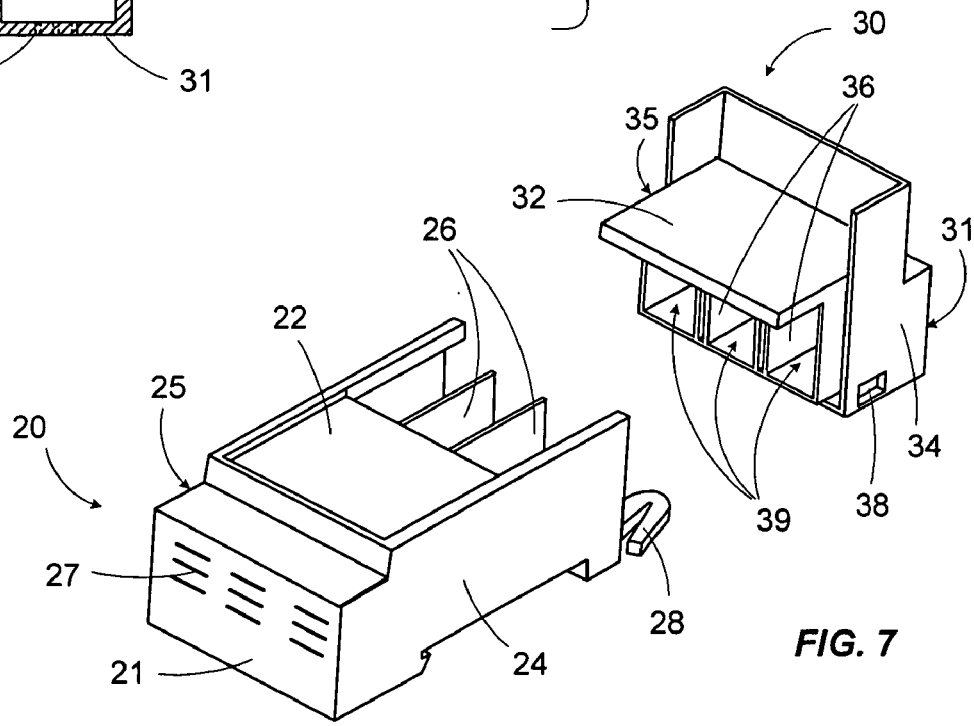

Other characteristics and advantages will become clear after reading the following detailed description with reference to an embodiment given as an example and represented by the attached drawings on which:

FIG. 1 shows a simplified side view of an example switching device according to the invention, FIG. 2 shows a sectional view of the first element of the switching housing of the switching device, FIG. 3 shows a simplified diagram of a trip system with a mechanical locking block and a magneto/thermal block, FIG. 4 shows a section of a polar switching assembly to be inserted in the switching device, FIG. 5 shows a sectional view of the switching device during assembly including the constituents of FIGS. 2, 3 and 4, with the second element of the switching housing of the switching device, FIG. 6 shows a sectional view of the switching device in FIG. 1, including the different constituents in FIG. 5 and a front face block, FIG. 7 shows a flat perspective view of the two elements of an empty switching housing of a three-pole switching device.

With reference to the different figures, an electrical switching device 10, for example of the circuit breaker, contactor or single pole or multi-pole contactor-circuit breaker type, is designed to control and/or protect a downstream electrical circuit by switching polar upstream current lines 75 to polar downstream current lines 59. Usually, the upstream current lines 75 can be connected to an upstream electrical power supply circuit through an upstream terminal block of the switching device 10 that is not shown in the figures. The downstream current lines 59 can be connected to an downstream load circuit through an downstream terminal block of the switching device 10 that is not shown in the figures.

Each power pole of the switching device has a polar switching assembly 80 like that shown diagrammatically in FIG. 4 that comprises a mobile conducting bridge 83 supporting two mobile contacts 84, 85 positioned on each side of a median horizontal axis X. The bridge 83 is mobile in translation along the displacement axis X along a forward/reverse direction so as to be able to separate or connect the mobile contacts 84, 85 of the bridge 83 with upstream and downstream fixed contacts 76, 56 of the switching device. The switching device is said to be in the closed position when the mobile contacts are in contact with the fixed contacts, so as to connect the upstream current line 75 and downstream current line 59, and is said to be in the open or tripped position when the contacts are separated.

In the example shown, the polar switching assembly 80 also comprises a pusher 78 capable of activating the mobile bridge 83 in the opening direction and a contact pressure spring, not shown, designed to activate the mobile bridge 83 in the closing direction. Obviously, other devices for displacement of the mobile bridge 83 are obviously also possible.

The polar switching assembly 80 on each side of the X axis of the mobile bridge 83 comprises a first arc extinguishing splitters block 81 and a second arc extinguishing splitters block 82, the purpose of which is to channel electrical arcs that occur when the mobile contacts 84 and 85, and the fixed corresponding contacts 76 and 56 respectively, are opened to guide the arcs outwards. Various known devices such as a deflector 89 may also be used to facilitate dissipation of electrical arcs. A trip that occurs after the occurrence of a strong current such as a short circuit current, when the contacts are opened, causes a large gas overpressure, these gases then being guided towards the external ends 81',82' of the splitters blocks 81,82.

Preferably, each polar switching assembly 80 is assembled in advance for reasons of convenience of assembly of its different component parts before being installed in a switching housing (or box) of the switching device 10. Therefore, this switching device must firstly open far enough for it to be easy to insert the switching assembly(ies) 80, and secondly to provide good resistance to gas overpressures once the switching device has been assembled.

This is why the switching housing of the switching device 10 according to the invention comprises two distinct elements 20,30. As shown in FIGS. 2 and 7, the first element 20 of the switching housing has two approximately parallel sidewalls 24, 25 between a back wall 23 and a front wall 22, and a bottom 21 connecting the vertical walls 22,23,24,25. Thus the first element 20 forms a first approximately parallelepiped shaped tank open on the side opposite the bottom 21. The cavity 29 of the first tank 10 fully or partially contains the first splitters block 81 of the polar switching assemblies 80. The bottom 21 of the first element 20 forms a first horizontal face of the housing of the switching device 10, for example a top face.

With reference to FIGS. 5 and 7, the second element 30 of the switching housing has two approximately parallel sidewalls 34,35, between a back wall 33 and a front wall 32, and a bottom 31 connecting the vertical walls 32,33,34,35. The second element 30 thus forms a second approximately parallelepiped shaped tank open on the side opposite the bottom 31. The cavity 39 of the second tank can fully or partially house the second splitters block 82 of the polar switching assembly(ies) 80. The bottom 31 of the second element 30 forms a second horizontal face of the housing of the switching device 10, for example a bottom face, opposite the top face 21.

Therefore, the two elements 20 and 30 are designed as two rigid half-boxes such that when the device 10 is assembled, they nest into each other so as to form a closed switching housing creating arc-control devices in the cavities 29, 39. Due to the tank shape open on one side, it is very easy to insert the polar switching assembly(ies) 80 in each half-box 20, 30 of the switching housing. Once assembled, the two elements 20, 30 are held to each other by attachment means, such as click fit means 28, 38, for example composed of an elastic device 28 of the element 20, the end of which can click fit into an opening 38 provided in element 30. Other attachment means such as attachment screws could also be used to hold the two elements 20,30 to each other.

In the case of a multi-pole switching device like that shown in FIG. 7, each element 20,30 also comprises a separation partition 26, 36 between each adjacent pole so as to isolate the poles from each other. Each partition 26 and 36 is fixed to the back walls 23 and 33 respectively, and the front walls 22 and 32 respectively, and to the bottom 21 and 31 respectively, of elements 20 and 30 respectively. These partitions 26 and 36 are approximately parallel to the sidewalls 24, 25 and 34, 35 respectively, and form a partitioning system that defines separate cavities 29 and 39 respectively, thus forming distinct arc-control devices for each pole.

FIG. 7 shows a three-pole switching device, in which each element 20,30 therefore comprises two separation partitions 26, 36. In the embodiment described, each separation partition 36 also comprises an inner recess in which the corresponding separation partition 26 is inserted. The result is that an overlap is created between the separation partitions 26, 36. This solution has the advantage that it guarantees a good seal between the different arc-control devices 29, 39 of the poles, it respects creepage distances between poles and increases the stiffness of the junction area between partitions 26 and 36.

An overlap would also be easily possible for the junction between the back walls 23 and 33 and between the sidewalls 24 and 44, 25 and 35. On the other hand, the front walls 22, 32 are arranged to leave sufficient space between them particularly to enable the pusher 78 for each pole to slide backwards.

Preferably, each element 20,30 of the switching housing is composed of a single part moulded from an insulating plastic material which simplifies manufacture of the switching device and which also provides a good seal between the different cavities 29,39 of each pole and better stiffness of the elements 20,30. Furthermore, the inside dimensions of the two elements 20,30 are designed such that when they are fixed in contact with each other, they can maintain the position of the switching assemblies 80 of the different poles located on the inside. Moreover, the bottoms 21,31 of the two elements 20,30 comprise several opening louvers 27,37 so as to evacuate gases from the different arc-control devices 29,39 to the outside, at the top and bottom of the switching device 10.

The junction area between the two elements 20,30 corresponding to the joint between the two assembled elements, is located in an approximately horizontal plane (see FIGS. 1 and 6) approximately parallel to the bottoms 21, 31 of the switching housing. In a conventional solution, the junction area between the tank and the cover is located near the front of the switching housing in an approximately vertical plane orthogonal to the horizontal displacement axis X. Furthermore, in such a switching device, the height of the switching housing is less than its depth, given the structure and the layout of the polar switching assemblies 80.

Thus, with the invention, the surface occupied by the junction area is significantly smaller than in a conventional solution. Consequently, for a given gas pressure, the pressure forces applied on the junction area between the two elements 20,30 are significantly smaller so that a better mechanical strength can be achieved. This arrangement also means that the different parts of the elements 20,30 can be stiffened, particularly at the separation partitions 26,36. Furthermore, the junction area between the two elements 20,30 may advantageously be kept away from the external ends 81',82' of the splitters blocks 81,82, to avoid the need to resist excessive overpressure. Due to this arrangement of the switching housing into two distinct elements 20,30, it becomes easy firstly to insert the preassembled polar switching assemblies, and secondly to obtain better resistance of the pole arc-control devices to gas overpressures.

Once assembled, the sidewalls 24,25 and 34,35 of the elements 20 and 30 form side faces of the housing of the switching device 10. The switching housing then forms a base of the switch 10 on which in particular a trip system could be fixed. Furthermore, means are provided on one of the sidewalls 23,33 of the switching housing for attaching the switch 10 onto any assembly support such as a DIN rail or other. In the attached figures, these attachment means are arranged on the back wall 23 of the element 20.

The switching device 10 comprises a trip system composed of one of several function blocks in order to control and/or protect the downstream electrical circuit. In the example presented, the trip system comprises an electromechanical magneto/thermal switching block 50 for each pole and a mechanical locking block 40. Similarly, it would be possible to consider using other function blocks such as a magnetic and/or thermal switching block with electronic detection.

The mechanical locking block 40 is provided with a lock 41 that applies a force on each pole pusher 78 in the opening direction in a known manner, for example through a connecting piece not shown in the diagram for reasons of simplification. Similarly, it is known that an electromechanical magneto/thermal switching block 50 carries the power current circulating in the corresponding pole and may be provided with a thermal trip device 51 in series, such as a bimetallic strip activated by a heater, and a magnetic trip device 52 composed of a magnetic coil and a striker that acts on the mobile bridge 83 of the pole in the opening direction, for example through a percussion rod passing through the pusher 78, not shown diagrammatically for simplification reasons.

For each pole, the switching device 10 comprises a fixed upstream conductor 75 forming the upstream current polar line and for which one end is approximately U-shaped, materialized by two legs 73 and 74 (see FIG. 2). One leg 74 of the U carries the fixed upstream contact 76 that cooperates with the mobile contact 84. According to the invention, the upstream conductor 75 is inserted in the switching device 10 by inserting the front wall 22 of the first element 20 of the switching housing inside the space located between the two legs 73, 74 of the U. The spacing between the legs 73,74 may be selected such that once the upstream conductor 75 is inserted, it is held in place by being stuck between the legs 73, 74 around the front wall 22.

Similarly, the switching device 10 also comprises a fixed conductor 55 on the downstream, for which one end is approximately U-shaped, as materialized by two legs 53 and 54 (see FIG. 3). One leg 54 of the U carries the downstream fixed contact 56 that cooperates with the mobile contact 85. In the example shown in FIG. 3, the downstream conductor 55 is connected in series to the thermal trip device 51, to the magnetic trip device 52 and then to the downstream current polar line 59. Therefore, the downstream conductor 55 is fixed to the magneto/thermal switching block 50 of the pole. When the block(s) 50 is (are) assembled in the switching device 10 (see FIG. 5), the front wall 32 of the second element 30 of the switching housing is inserted in the inner space between the two legs 53,54 of the U of each downstream conductor 55, so as to hold and lock the trip system at the same time as the switching housing is closed. The distance between the legs 53,54 may be designed such that the downstream conductor 55 is held in place by being stuck between the legs 53,54 around the front wall 32.

The invention also relates to a simple and fast method of assembling an electrical switching device like that described above. According to the invention, the method includes the following in sequence:

A first insertion step A to insert each polar switching assembly 80, already mounted in a arc-control device created by each cavity 29 of the first element 20 of the switching housing. The open tank shape of the first element 20 makes insertion through the opening in the tank very easy. This step is shown diagrammatically by arrow A from the bottom upwards between FIG. 2 representing the first element 20, and FIG. 4 representing a switching assembly 80. The upstream polar conductor(s) 75 is (are) either inserted in a preliminary insertion step, or are inserted during step A, particularly if they are assembled beforehand with the polar switching assembly(ies) 80. The legs 74, 73 of the U are placed on each side of the front wall 22 of the first element 22 so as to hold the upstream conductor 75 in a fixed position, for example by sticking or wedging or trapping it.

A second hanging step B to hang the trip system 40, 50 of the switching device 10 against the first element 20. This step is shown diagrammatically by arrow B between FIG. 2 and FIG. 3, representing a trip system 40,50. Step B may be divided into several phases, depending on the number of function blocks making up the trip system. In a switching device 10 for which the trip system includes a mechanical locking block 40 and one or several magneto/thermal switching blocks 50, the hanging step B comprises a first step to hang the locking block 40 against the front wall 22 of the first element 20. For example, the locking block 40 may be inserted by a vertical movement from top to bottom and held in place in contact with the first element 20 by a sliding, a dovetail or other means, locking any vertical movement of the block 40. The hanging step B then comprises a further hanging step to fix each magneto/thermal block 50 to the assembly composed of the first element 20 and the block 40. For example, the magneto/thermal block 50 may be inserted in a horizontal movement and held in place to the locking block 40 by a sliding, dovetail or other means, until it comes into contact with the first element 20. Once each magneto/thermal block 50 has been fixed to the locking block 40, the complete trip system may thus be blocked to prevent any vertical movement. The result is then the assembly shown diagrammatically at the top of FIG. 5. During this step, the devices acting on the pushers 78 are also put into place.

A third fixing step C to fix the second element 30 to the first element 20 so as to close the switching housing and also enable final locking of the trip system in contact with the switching housing. The open tank shape of the second element 30 makes it easy to insert the second splitters block 82 of each polar switching assembly 80, previously inserted into the first element 20, into an arc-control device created by each cavity 39. This step is shown diagrammatically by the arrow C from the bottom to the top of FIG. 5. During the step C, the front wall 32 of the second element 30 is inserted and is held in place, for example by sticking or wedging or trapping, between the two legs 53 and 54 of the U of each downstream conductor 55 fixed to each magneto/thermal block 50, so that the trip system can be completely locked.

The second element 30 is attached to the first element 20 preferably by click fit means 28, 38 or by other means such as screws. Therefore, this step C advantageously completely locks the trip system using the front wall 32, and closes the switching housing in a single operation, by fixing the second element 30 to the first element 20. The result is a fast, simple and efficient method of assembling the switch.

A further attachment step can then be used to position a front face block 60 with control and/or display devices included in the switching device 10, in front of the trip system 40,50, to finally obtain the assembled switch 10 as shown in FIGS. 1 and 6.

In addition to the advantages mentioned above, this type of design is very modular; each module of the switching device 10 may be designed and assembled separately from the others (polar switching assembly, locking block, magneto/thermal block, front face block, etc.) which facilitates firstly replacing one module by another during maintenance operations, and also facilitates the design of electrical switches comprising different functions starting from the same base, or the design of a wide range of switches using some common modules.

Obviously, it would be possible to imagine other variants and improvements to detail and even to consider the use of equivalent means, without going outside the framework of the invention.

The invention claimed is:

1. An electrical switching device with a switching housing designed to be fitted with at least one switching polar assembly (80) comprising two are extinguishing splitter blocks (81,82) located on each side of a contact bridge (83) movable along a horizontal displacement axis (X), wherein, the switching housing comprises:

a first element (20) comprising two sidewalls (24,25), one back wall (23), one front wall (22) and a bottom (21) comprising a first horizontal face of the switching device (10), forming a tank with a cavity (29) that houses a first splitter block (81) of the polar switching assembly, a second element (30) distinct from the first element (20) and comprising two side walls (34,35), one back wall (33), one front wall (32) and a bottom (31) comprising a second horizontal face of the switching device (10), opposite the first horizontal face, forming a tank with a cavity (39) that houses a second splitter block (82) of the polar switching assembly, wherein the first and second elements (20,30) are joined to form the switching housing.

2. The electrical switching device according to claim 1, wherein, each element (20,30) also comprises a separation partition (26,36) between each adjacent pole fixed to the back (23,33) and front (22,32) walls and to the bottom (21,31) of said element (20,30).

3. The electrical switching device according to claim 1, wherein, each element (20,30) of the switching housing is composed of a single moulded part.

4. The electrical switching device according to claim 1, wherein, the front walls (22,32) are arranged to leave sufficient space between them to enable sliding of a pusher (78) for each pole, that will activate the mobile contacts (83) of the pole.

5. The electrical switching device according to claim 4, comprising an approximately U-shaped upstream conductor (75) for each pole carrying a fixed upstream contact (76), wherein, the front wall (22) of the first element (20) may be inserted in the U of each upstream conductor (75).

6. The electrical switching device according to claim 1, comprising a trip system that can activate the mobile contact bridge (83) of each pole of the switching device, said trip system comprising an approximately U-shaped downstream conductor (55) carrying a fixed downstream contact (56), the front wall (32) of the second element (30) being inserted in the U of each downstream conductor (55), so as to lock the trip system in contact with the switching housing.

7. The electrical switching device according to claim 6, wherein the trip system comprises a mechanical locking block (40).

8. The electrical switching device according to claim 6, wherein the trip system comprises a magneto/thermal block (50).

9. The electrical switching device according to claim 1, wherein the first element (20) and the second element (30) are held to each other by click fit means (28,38).

* * * * *